United States Patent [19]

Zentner

[11] 4,282,048

[45] Aug. 4, 1981

[54] METHOD FOR COOLING HOT-ROLLED SHAPES

[76] Inventor: John W. Zentner, 42238 Edwards Cir., Columbiana, Ohio 44408

[21] Appl. No.: 91,869

[22] Filed: Nov. 6, 1979

[51] Int. Cl.[3] ..... C21D 9/00

[52] U.S. Cl. ..... 148/155

[58] Field of Search ..... 148/153, 155, 156

[56] References Cited

U.S. PATENT DOCUMENTS 3,909,315 9/1975 Akayama et al. ..... 148/155

*Primary Examiner*—R. Dean

*Attorney, Agent, or Firm*—Thomas H. Murray; Clifford A. Poff

[57] ABSTRACT

A walking beam section of a cooling bed receives hot lengths of rails or beams for cooling through a first temperature range. Beams are turned at the end of the walking-beam section and positioned into a layered collection after which the collection is transferred throughout a second section of the cooling bed to a delivery section where chain conveyors deliver the beams to a run-out table for inspection and straightening. A layered collection of rails is moved from the delivery side of the walking-beam section to one of a plurality of discharge stations defined along the subsequently-arranged cooling bed section. Before the rails cool to a temperature below 725° F., typically at 950° F., the rails at each discharge station are lifted by a crane and transferred in the direction of their length to one of a plurality of insulated cooling boxes at one lateral side of the cooling bed. After the rails are slowly cooled in the cooling boxes, they are removed for further processing.

6 Claims, 6 Drawing Figures

C18
C17
C16
C15
C14
C13
C12
C11
96
C8
C7
C6
C5
C4
C3
C2
C1
95
45
44
43
42
41
46
78
81
82
79
84
D8
D7
D6
D5
D4
D3
D2
D1
16
76
65
77
83
10
11
12
13
14
15
21
22
24
25

METHOD FOR COOLING HOT-ROLLED SHAPES

BACKGROUND OF THE INVENTION

This invention relates to a method and apparatus for cooling hot lengths of rolled workpieces, such as rails and structural shapes, through maximum utilization of a cooling bed embodying a construction and having facilities to handle workpieces more efficiently on the cooling bed for either complete cooling of certain workpieces, such as structural shapes or partial cooling of other workpieces such as rails which undergo continued specialized cooling in facilities adjacent the cooling bed.

Because of the capital investment required for a rolling mill installation, it is desirable to utilize the facilities to produce different hot-rolled products having varying cross-sectional configurations. For example, one class of product, namely structural shapes including beams, and a second class of product, namely rails, can be processed at different times in the same rolling mill installation after suitable set-up operations including roll changing. The same cooling facilities for the workpieces can be used, at least in an initial cooling phase, to reduce the temperature of the workpieces down to a desired temperature. Rails intended for railroad service require controlled cooling within a temperature range of not less than 725° F. down to at least 300° F. This cooling process was developed to prevent the formation of shatter cracks, also called internal thermal ruptures, flakes, or internal thermal cracks. In mill operations, the rails are allowed to cool to about 1000° F. and then the rails are placed in either stationary or movable insulated containers. Each rail must be placed in the container within a temperature range of between 1000° F. and 725° F. Thermocouples are placed between tiers of rails in the slow-cool container in order to obtain temperature readings during cooling. The containers are usually insulated to meet the specific cooling cycle. One such cycle requires that the temperature of the rails does not fall below 300° F. in seven hours for rails at 100 pounds per yard in weight or heavier from the time the bottom tier is placed in the container. Five hours are required to cool rails to a temperature not below 300° F. in the containers according to another cooling cycle when the rails are less than 100 pounds per yard in weight. The rails usually remain in the cooling containers for a minimum of 10 hours. Complete records are maintained of the cooling cycle for the rails in each container.

The problem occurs, however, as to the manner and facilities which are needed to cool the rails from the elevated temperature at which they arrive at a cooling bed down to the desired temperature at which the rails are placed in the cooling boxes. Thus, it is necessary to subject the rails to one cooling rate over a first temperature range and thereafter to a different cooling rate over a second temperature range. Since different apparatus is required to carry out the cooling of the rails at the second temperature range, it is necessary to keep the rails moving while cooling over the first temperature range to make room for further products coming from the mill and avoid a bottleneck in the mill-processing line. In a rolling mill installation for producing rails and beams, it has been proposed to use a cooling bed to cool rails from a cooling bed entry temperature of about 1800° F. down to a temperature of about 90° F. A delivery roller table incorporated into the cooling bed is used to discharge the rails transversely to their movement across the bed. After the rails are removed from the cooling bed, they are rotated to a head-up position and then packed into groups of about eight rails to form a layer which is then lifted by an overhead crane equipped with magnets and loaded into cooling boxes. Usually, two packing beds are required because while a group of rails from one packing bed is loaded into a cooling box, a layer of rails is accumulated on the other packing bed to assure loading of the rails into the cooling boxes at an optimum entry temperature. The present invention eliminates the need for packing beds as well as the conveying tables needed to remove rails from a cooling bed, thereby eliminating a substantial capital investment required for the specialized handling of rails while, at the same time, providing an improved method and cooling bed apparatus which are capable of carrying out the required treatment of rails and beams or other rolled structural shapes.

To minimize damage to the hot lengths of rolled shapes, it has been proposed to use a walking-beam type cooling bed incorporating a rectangular pickup and set-down pattern and by adjusting the speed of operation by the movable members of the walking-beam bed, the range of residence time for the hot-rolled shapes being controlled to meet cooling requirements. Since wide-flange beams, for example, are cooled to ambient temperature on the cooling bed, the length of the cooling bed with respect to the direction of movement of the hot lengths of beams is selected for the necessary residence time to cool the beams. As the temperature of the beams is reduced during movement across the cooling bed, there is also a concurrent reduction to the possible damage to the beams because of contact with members used to advance the beams. Thus, it is practical to construct the cooling bed with a first section incorporating a design of a walking-beam type bed and a downstream section of a different design with a chain conveyor or similar mechanism for advancing the beams in succession along the bed. However, two distinct drive systems are used each in a different area to advance workpieces across the entire bed. A mechanical failure to one drive system adversely affects complete unloading of rolled workpieces from the bed.

SUMMARY OF THE INVENTION

It is an object of the present invention to provide a method and apparatus for handling hot lengths of hot-rolled shapes for cooling in a more efficient and economical manner than heretofore known in the art.

It is a further object of the present invention to provide a method and apparatus to cool hot-rolled shapes while advancing along a cooling bed including the repositioning of the shapes on the bed into a layered collection for movement as a collection to at least one predetermined discharge station on the bed and removal therefrom into a cooling container to carry out continued cooling of the hot-rolled shapes.

More particularly, the present invention provides a method including the steps of cooling hot lengths of rolled shapes at a first cooling rate on a first bed section of a cooling bed by laterally advancing the shapes therealong at a first selected spacing, thereafter forming a layered collection of hot-rolled shapes having a second selectable spacing on the cooling bed, positioning the layered collection of hot-rolled shapes along the cooling bed on at least one predetermined discharge station on the cooling bed, loading the layered collection of hot-rolled shapes into a container, cooling the hot-rolled shapes in the container and unloading the hot-rolled shapes from the container after cooling.

In a corresponding way, the apparatus of the present invention includes a cooling bed with means to reposition hot-rolled shapes after cooling in a first bed section into a layered collection comprised of a plurality of hot-rolled shapes at a second selectable spacing which is different from the first-selected spacing at which the beams are cooled on the bed, transport means to advance the layered collection along the bed to at least one predetermined discharge station on the bed, a cooling container discrete from the cooling bed at the layered station, and means to transfer the layered collection of hot-rolled shapes from the layered station on the bed into the cooling container.

In the method and apparatus of the present invention, the hot-rolled shapes, such as rails, are moved directly from the discharge station on the cooling bed into a container at a temperature of 1000° F. but not less than 700° F. for cooling in the container down to a temperature of at least 300° F. Preferably, a plurality of discharge stations is defined along the cooling bed and there being provided a cooling container discrete from the bed and adjacent each discharge station. Other hot-rolled products such as structural shapes including beams are cooled to ambient temperature on the bed while transported by conveyor means to the discharge end of the cooling bed. The transfer of a layered collection of hot rails is preferably carried out by the same apparatus used to move the structural shapes to the discharge side of the bed after cooled to ambient temperature.

These features and advantages of the present invention as well as others will be more fully understood when the following description is read in light of the accompanying drawings, in which.

For purposes of disclosing the preferred embodiment of the present invention, cooling of rails and beams will be described; however it is to be understood that cooling of other hot-rolled sections may be carried out without departing from the spirit and scope of the present invention by using the method and apparatus thereof.

Figure 1:
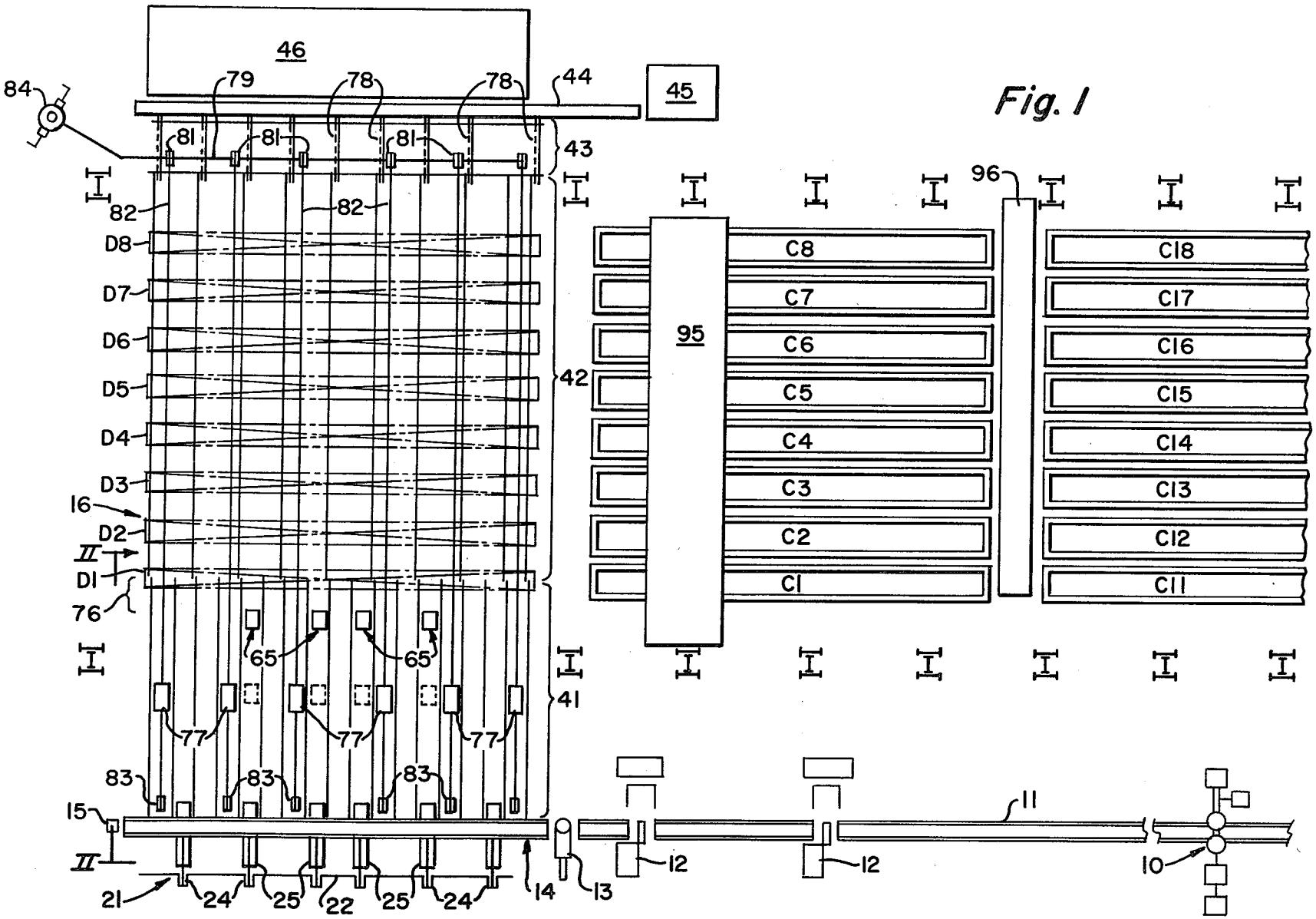
FIG. 1 is a plan view of apparatus for cooling hot-rolled shapes which is preferred to carry out the method of the present invention.

In FIG. 1, reference numeral 10 identifies a universal finishing mill and the last mill stand in a mill train. The rolled workpiece discharged from the universal finishing mill 10 is transferred by a run-out table 11 to one or more hot saws 12 where the workpiece is subdivided into desired lengths of hot-rolled sections after which they are conveyed to a marking machine 13 where the hot lengths of rolled shapes are marked with identifying indicia. An entry table 14 transfers the succession of cut lengths of rolled sections to an entry position at an end stop 15 for transfer onto a cooling bed 16. It is to be understood that, depending upon a rolling schedule, a succession of workpieces will be processed in the rolling mill train to produce rails after which roll-changing and other set-up operations will be carried out on the mill train for processing a succession of workpieces to produce beams. Thus, throughout a given time period, only lengths of rails will be conveyed by entry table 14 for transfer onto the cooling bed and during a different time period, only beams will be conveyed by the entry table for transfer onto the cooling bed.

Figure 2:
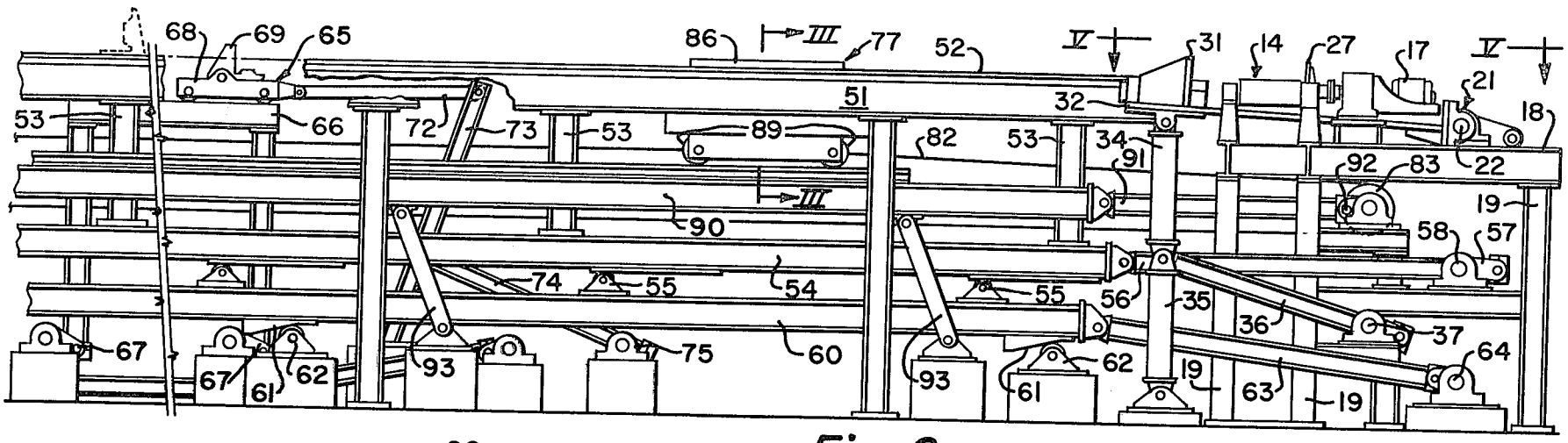
FIG. 2 is an enlarged end elevational view taken along line II—II of FIG. 1.
Figure 5:
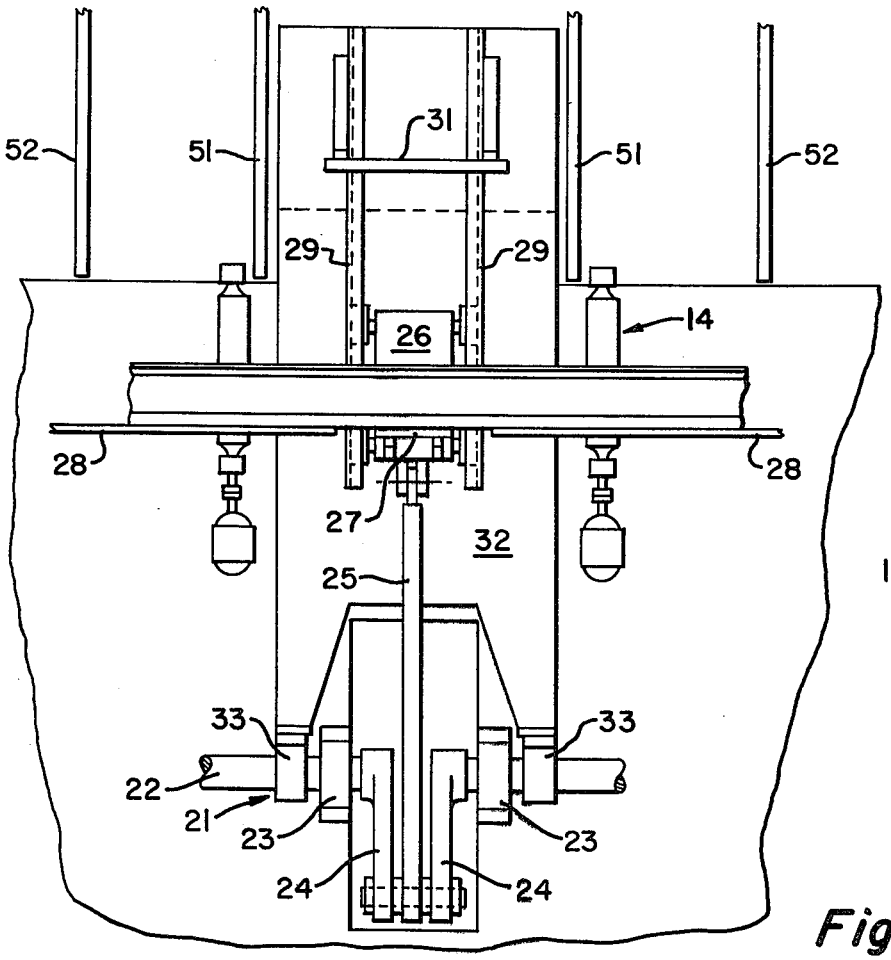
FIG. 5 is a partial plan view taken along line V—V of FIG. 1.

As shown in FIG. 2, the entry table 14 includes spaced-apart rollers 17 each supported by bearings and driven by a motor. Entry table 14 is carried on a platform 18 supported by pedestals 19 extending to a foundation. As will be described in greater detail hereinafter, the space beneath the platform 18 is used for drive systems for the cooling bed. As shown in FIGS. 1, 2 and 5, an unloader 21 is constructed to form a combined beam transfer and rail cambering apparatus. A drive shaft 22 extends along the drive side of table 14 at each of the spaced-apart locations where pairs of bearing assemblies 23 support the drive shaft. Between each pair of bearing assemblies, the drive shaft includes crank arms 24 coupled by a ram 25 to an unloader car 26.

Car 26 supports an upstanding dog 27 that is manually positioned along the body of the car. At the rest position of the unloader, each dog 27 projects into a gap between side guides 28 extending along the drive side of the entry table 14. The unloading car 26 has wheels supported by parallel channel sections forming rails 29 located between two rollers of the entry table 14. The rails 29 extends into the cooling bed where, as shown in FIG. 5, they are disposed between the rails of the cooling bed below the workpiece-supporting surfaces thereof. An upstanding plate forms a dog 31 that is attached by bolts or other fasteners at a selected adjustable location along rails 29. A carrier plate 32 supports the rails 29 and extends beyond the rails at the drive side of entry table 14 where it is pivotally supported by bearing blocks 33 journaled on drive shaft 22. By this construction, pivotal movement of support plate 32 about shaft 22 either raises or lowers the dog 31 so that it projects above the workpiece-supporting surface of the cooling bed or lies below this surface. This movement of the plate is achieved, as shown in FIG. 2, by a generally vertical arrangement of links 34 and 35. Link 34 is pivotally attached to the underside of plate 32 and link 35 is pivotally supported by a clevis mounting that is foundation-supported. The free ends of links 34 and 35 are joined by a pivot shaft that also engages one end of a ram 36. The ram 36 extends into the space beneath the platform 18 where it is journaled onto the crank arm of a drive shaft 37 supported by bearing blocks on a foundation structure. The drive shaft 37 is coupled to a drive motor, not shown, so that the throw of the crank arm moves ram 36 in the direction of its length to thereby pivotally displace the ends of links 34 and 35 which are joined together by the pivot pin. This displacement shortens the effective height of the links whereby the support plate 32 and the structure supported thereby including dog 31 move below the top surface of the cooling bed.

Figure 3:
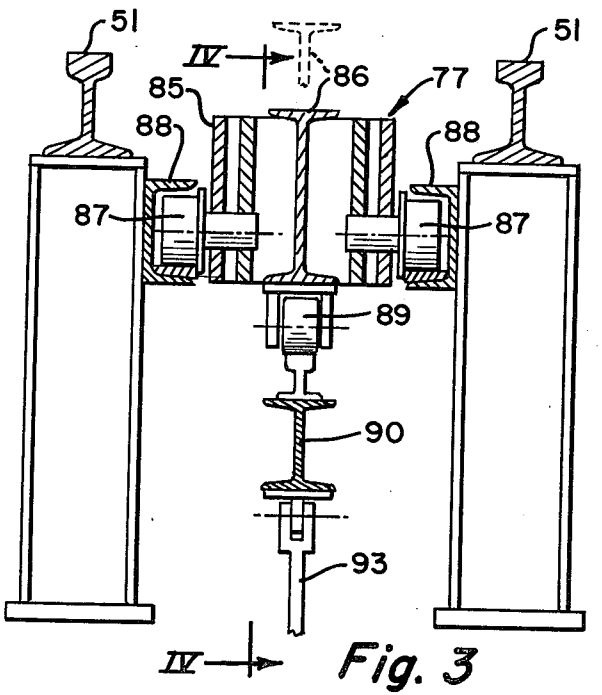
FIG. 3 is an enlarged sectional view taken along line III—III of FIG. 2.
Figure 4:
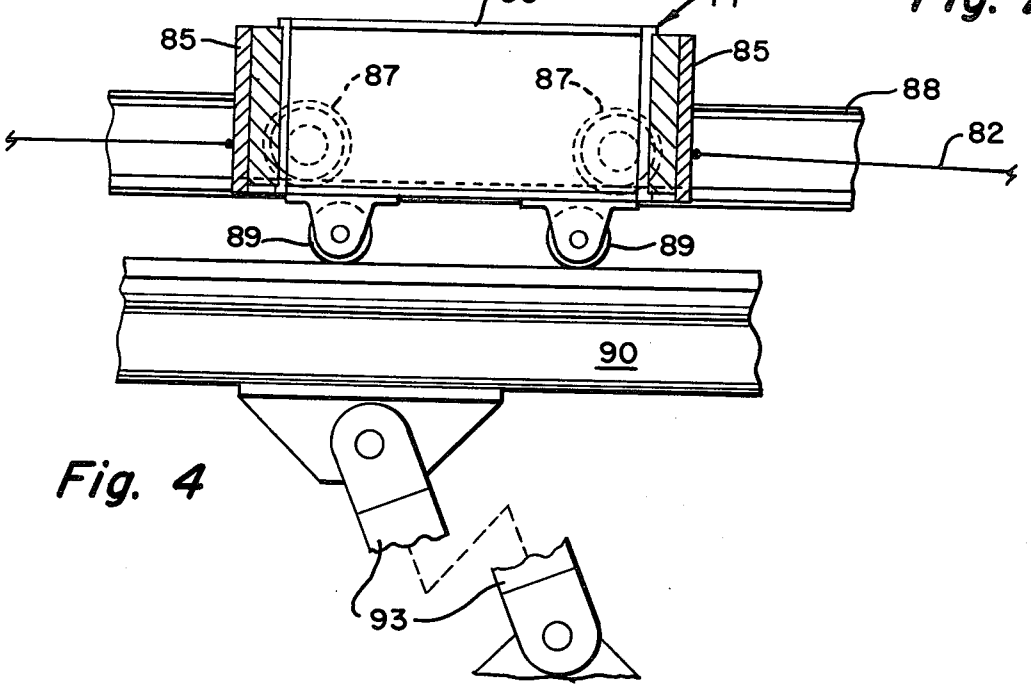
FIG. 4 is a sectional view taken along line IV—IV of FIG. 3.

After a rail, beam or other structural shape is transferred along entry table 14 to a stationary position adjacent stop 15, the unloader at each of the spaced-apart locations along the entry table 14 is energized for carrying such a workpiece onto the cooling bed at an entry temperature of about 1800° F. The unloader functions 82, there is an idler pulley 83 rotatably supported adjacent the entry side of the walking-beam section 41 of the cooling bed. A drive motor 84 is coupled to rotate the line shaft 79. Each transfer car 77 is connected to a cable 82 and drawn back and forth by the cable through a travel distance which is between the pulleys 81 and 83. As shown in FIGS. 2–4, each transfer car 77 includes adjoined side walls 85 that surround a hollow internal opening wherein there is a support platen 86 guided by the end walls of the car for vertical movement. Wheels 87 on the car move along channel members 88 attached to support columns for the rails 51. Other wheels 89 on the bottom of the support platen engage the top surface of a lifting rail 90 which is moved in the direction of its extended length by a ram 91 coupled to the eccentric portion of a crankshaft 92. The crankshaft 92 is supported by bearing blocks on a platform arranged in the space beneath platform 18. Crankshaft 92 is coupled to a suitable motor to reciprocate the ram 91 and move the lifting rail 90 along an arcuate path because of its support by pivot links 93. The links 93 are each attached by a pin at one end to the undersurface of rail 90; while the free end of each link is attached by a pivot pin to a raised foundation support. As the rail 90 moves along the arcuate path, the support platen 86 is displaced vertically within the side walls of the car 77. In this way, the support platen is raised to extend above the workpiece-supporting surface of the cooling bed. When this occurs, workpieces on the cooling bed are lifted and supported by the transfer car.

In the preferred aspect of the present invention, the cooling sequence for hot lengths of workpieces is initiated by the marking machine 13. A workpiece discharge from the universal finishing mill 10 is subdivided into desired lengths by the operation of hot saws 12 and gages associated therewith. The subdivided length of each rail or beam by the operation of the hot saws is used via a corresponding electrical signal to establish the positioning sequence for either long or short workpieces on the entry table with respect to the width of the cooling bed. After each subdivided length of workpiece is marked, the entry table 14 moves it at a temperature of about 1800° F. into a position for discharge onto the cooling bed. When the marked subdivided length of workpiece takes the form of a rail, the dogs 27 and 31 at each location along the entry table are mutually positioned. The selected position of one dog with respect to an adjacent and opposed dog establishes the desired amount of rail camber. Cambering takes place by permitting the rail to bend in the direction of its length by contact with the dogs while carried by the cars of the unloader from the entry table onto rails 51 and 52 of the walking-beam section 41 of the cooling bed. The unloader cars lift the rail from the table by movement of links 34 and 35 into a straight-line position as shown in FIG. 2. Crank arms 24 at each location along the table are rotated, thereby displacing the cars toward the cooling bed such that the dogs 27 engage the rail. After the rail is brought against the surfaces of dogs 31, the drive shaft 37 is rotated and the links 34 and 35 are moved from the straight-line position to bring about a lowering of the dogs as well as the unloader cars so that the rail is now supported by the cooling bed. Drive shafts 58 and 64 are then caused to rotate so that the movable rails 52 undergo a rectangular motion wherein the rail is first raised from the cooling bed, advanced a preselected distance along the cooling bed and then lowered back into supporting engagement with the cooling bed.

Of course, rails to be cooled are introduced onto the cooling bed in succession and the space between the rails is selected according to the operation of the unloader in relation to the advancing movement of the rails by the operation cycle of the walking-beam section 41. As the rails are advanced in succession across the cooling bed section 41, the presence of each rail is determined just prior to its advancing movement above the turner 65. The rail is lifted and rotated by turner 65 into a position where it is supported by the bottom flange of the rail. Operation of the turner also brings about an advancing movement of the rail to a position in the layering station 76 where it is deposited onto the support surface of the cooling bed in a closely, spaced-apart relation with a rail previously located at the station or at a position which forms the first of a layered collection of rails. The rails of the layered collection are set at a closely-spaced pattern wich is dependent upon the cross-sectional size of the rails. A position control coupled to the turner can be used to establish the preset spacing between the rails. Typically, eight rails are accumulated at the layering station before the transfer cars 77 are moved beneath the layered collection. The support platen 86 of each car is then raised to support the rails which drive motor 84 is energized to advance the car along cooling bed section 42 to a selected one of a plurality of predetermined discharge stations on the cooling bed section 42. Eight predetermined discharge stations are shown in FIG. 1 and are identified by reference numerals D1–D8. The layered collection of rails is then lowered for supported by the skids of the cooling bed section 42. The rails have now cooled to a temperature of about 1000° F. It will be observed in regard to FIG. 1 that each discharge station established on the cooling bed section 42 is adjacent to and in alignment with cooling boxes C1–C8 and C11–C18. The layered collection of rails is lifted from each of the discharge stations D1–D8 while the temperature of the rails in the collection is above 725° F. and typically at a temperature of 950° F. by an overhead crane 95 equipped with electromagnets spaced along a spanner bar. The crane is operated to lift a layered collection of rails from a discharge station and to transport the rails directly above one of the aligned cooling boxes. Thus, for example, a layered collection of rails at discharge station D2 is lifted therefrom by the crane and deposited in either cooling box C2 or C12 depending, of course, upon which cooling box is available for the rail-loading operation. After several layers of rails have been placed in each cooling box and thermocouples or similar apparatus are placed between the tiers of the rails, a lid is placed on the box, thus forming a container. As previously described, the container is insulated to meet the specific cooling cycle. The rails usually remain in the cooling containers for a minimum of ten hours. At the end of the cooling cycle, the lid is removed and the crane is used to unload the container. A rail discharge table 96 located between the two groups of cooling boxes receives the rails at a temperature of 300° F. or less for delivery to an inspection and/or other processing station. The aligned arrangement of discharge stations with cooling boxes greatly facilitates efficient and rapid handling of the layered collection of rails without endangering spoilage of rails because the temperature had fallen below 725° F. before initiation of the cooling cycle in the cooling boxes. Moreover, the invention greatly reduces the capital investment required through a reduction to the equipment necessary for executing as a straightener when the dogs 27 at each location along the entry table are manually set into an aligned relation to engage a workpiece within a vertical plane. The unloader functions as a cambering device when dogs 27 are set at laterally-displaced locations from the vertical plane. At the same time, dogs 31 are set at similar laterally-displaced locations.

The cooling bed 16 is made up of a walking-beam section 41, a downstream cooling section 42 and a cooling bed delivery section 43. At the discharge side of the cooling bed delivery section 43, there is a run-out table 44 extending to a straightener 45. Extending along the run-out table 44 is a beam repair facility 46.

Beams, for example, arrive on the entry table 14 with their flanges extending vertically and they are moved across the walking-beam section 41 with their flanges vertical. The walking-beam section is essentially made up of a first series of stationary rails 51 supported at spaced-apart intervals across the width of the cooling bed and extending in a direction which is parallel with the direction of advancement by the workpieces along the cooling bed. The stationary rails 51 are supported by vertical post members extending to the floor where they are anchored to foundation supports. Movable rails 52 are disposed in a parallel relation within the space between the stationary rails 51. The movable rails are raised from below to above the stationary rails and moved in the direction of their length with a rectangular motion to pick up and support workpieces from the stationary rails, advance them in the direction toward the discharge end of the cooling bed by an adjustable-selected distance, and then lower the workpieces for support on the stationary rails. While various forms of drive means may be employed for this purpose, the preferred arrangement of parts, as shown in FIG. 2, includes movable rail support posts 53 extending vertically between each rail and a horizontal displacement rail 54. On each rail 54 there are wear plates that engage rollers 55 for support while moved in the direction of their length by a drive that includes a ram 56 coupled to one end of the rail. The free end of ram 56 is mounted onto an eccentric journal of a crank arm 57. For each ram, there is a crank arm which is part of a drive shaft 58 carried for rotation by bearing blocks on raised foundation supports within the space between platform 18. The drive shaft 58 is driven by a suitable motor, not shown. The rollers 55 for each rail 54 are supported upon the top surface of a lifting rail 60 having on its bottom surface a series of spaced-apart wedges 61 engaging roller supports 62 carried by elevated foundation blocks. A ram 63 is coupled at one end to lifting rail 60 and journaled onto the crank arm of a drive shaft 64 which is, in turn, supported by bearing blocks on an elevated foundation beneath the platform 18. The drive shaft 64 is coupled to a drive motor, not shown, such that rotation of the drive shaft brings about a vertical displacement of rail 60 as the wedges 61 move along roller supports 62. Because the rail 54 is supported by rail 60, the movable workpiece-engaging rails 52 are raised above the top surfaces of stationary rails 51. In this way, workpieces are lifted from the stationary rails after which the drive motor coupled to the support shaft for crank arms 57 is energized, thus moving rails 54 longitudinally whereby the movable workpiece-engaging rail 52 either carries a workpiece an incremental distance, as determined by the displacement of the rails, toward the discharge end of the cooling bed or when the rails 52 are below stationary rails 51, executes a return movement, thereby defining the previously-described rectangular pickup and set-up pattern. Such a pattern imparts a step-like advancing movement to the workpieces that minimize damage to the product, particularly in view of their elevated temperature.

Figure 6:
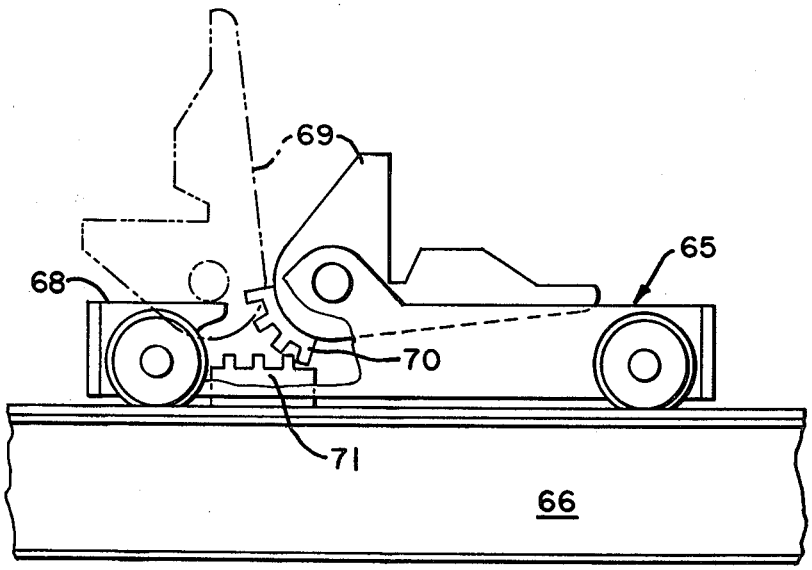
FIG. 6 is an enlarged view of the workpiece-turning apparatus shown in FIG. 2.

Beams are cooled from an entry temperature of about 1800° F. while advanced in a direction normal to the direction of their extended length along the walking-beam section 41 of the cooling bed. As each beam reaches the last space on the walking-beam section 41 of the cooling bed before a turner assembly 65 (FIG. 1, a sensor (not shown) detects the presence of the beam. At this point, the turner is energized to lift and rotate the beam at a temperature of between 1000° F. and 1200° F. for repositioning thereof so that the flanges are horizontal, whereby the beam is supported by only one flange. The preferred form of the turner is illustrated in FIGS. 2 and 6 and essentially includes platforms 66, each at spaced-apart locations between rails 51 and 52 (FIG. 1). Each platform 66 is raised and lowered by crank arms 67 that are part of crank-shafts carried by bearing blocks on raised foundation supports. The crankshafts of the crank arms 67 are coupled to a drive motor, not shown. The platform 66 carries a wheeled car 68. The car supports a pivot shaft for a turner arm 69 which also includes a gear segment 70. The turner arm has a generally L-shaped configuration to rotate a workpiece about the pivot shaft of the arm from a flanged vertical position to a flanged horizontal position. This is accomplished by causing the turner arm 69 to rotate about its pivot shaft due to the meshing engagement of the gear segment 70 with a stationary rack 71. The motivating force to effect this rotation is provided by displacing the car along the platform 66 through the agency of a reciprocating drive in the form of links 72 coupling the car to a pivot arm 73. Pivot arm 73 is supported for pivotal movement at its lower end; while coupled to the mid-portion thereof is a ram 74 extending to a crank 75. The crank 75 is part of a crankshaft supported by bearing blocks on a raised foundation support and driven by a motor, not shown. As an incident to the turning of a workpiece, the workpiece is advanced from one position on the walking-beam section of the cooling bed to a downstream section thereon. After a beam is rotated by the turner device, it is deposited on the cooling bed in a closely, spaced-apart pattern at a layering station 76. The layering station 76 is comprised of, for example, the last five feet of the walking-beam section of the cooling bed. Transfer cars 77, sometimes referred to in the art as go-devil transfer cars, act in unison to lift and carry a plurality of the closely, spaced-apart beams from the layering section 76 across the cooling bed section 42 to the discharge end thereof where they are deposited for continued transfer by delivery section 43 of the cooling bed. Delivery section 43 includes spaced-apart transfer chains 78 with dogs or other projections that engage the beams in succession for transfer to the run-out table 44 at ambient or a relatively low temperature, e.g., 300° F. The beams are inspected and repaired, if necessary, at repair station 46 before delivery to beam straightener 45.

Returning now to the transfer cars 77 and as shown in FIG. 1, a line shaft 79 extends across the width of cooling bed section 43. A pulley 81 is secured to the line shaft at each of spaced-apart locations at sites which are selected so that a cable 82 extends along the length of the cooling bed section 42 and thence between rails 51 and 52 of the walking-beam section 41. For each cable the required handling of rails on a cooling bed which also is equally efficient for cooling beams or other structural shapes without added or drastic changes to the component parts thereof.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A method for cooling hot-rolled shapes, said method including the steps of:

cooling hot lengths of rolled shapes, at a first cooling rate on a first bed section of a cooling bed by laterally advancing the shapes therealong at a first selected spacing, thereafter forming a layered collection of hot-rolled shapes having a second selectable spacing on said cooling bed to reduce the cooling-rate thereof as compared with the first cooling rate in said first bed section, moving the layered collection of hot-rolled shapes along the cooling bed to at least one predetermined discharged station on said cooling bed, loading the layered collection of hot-rolled shapes into a container, cooling the hot-rolled shapes in said container, and unloading the hot-rolled shapes from said container after cooling.

2. The method according to claim 1 wherein said step of cooling hot lengths of rolled shapes at a first cooling rate includes reducing the temperature of the rolled shapes from about 1800° F. to about 1200° F., and wherein the hot-rolled shapes at the predetermined discharge station on the cooling bed have a temperature of about 1000° F.

3. The method according to claim 1 or 2 wherein said step of cooling the hot-rolled shapes in said container includes reducing the temperature of said shapes from not less than 700° F. down to at least 300° F.

4. The method according to claim 1 wherein said hot-rolled shapes include rails and structural shapes and wherein rails are treated by said steps of loading the layered collection, cooling the hot-rolled shapes in said container and unloading the hot-rolled shapes and wherein said structural shapes are treated by discharging such shapes from the layered collection thereof at said predetermined discharge station from the cooling bed by a beam transfer, and transporting the structural shapes for inspection after delivery from the cooling bed.

5. A method for cooling hot-rolled shapes, said method including the steps of:

cooling hot lengths of rolled shapes on a first bed section of a cooling bed by laterally advancing the shapes therealong along a direction extending transverse to their lengths, thereafter effecting a closely-spaced collection of hot-rolled shapes on a second bed section of said cooling bed by moving them only in a direction extending transverse to their lengths to thereby reduce cooling thereof as compared with their cooling in said first bed section, removing the closely-spaced collection of hot-rolled shapes from the second bed section by moving them in a direction parallel to their longitudinal lengths, loading the closely-spaced collection of hot-rolled shapes into a container after they have been removed from said second bed section, cooling the hot-rolled shapes in said container, and unloading the hot-rolled shapes from said container after cooling.

6. A method for cooling elongated hot-rolled shapes issuing from a rolling mill which comprises:

conveying said shapes in a first direction after rolling to an entry table, transferring said shapes from the entry table to a cooling bed along a second direction which is essentially perpendicular to said first direction, moving said shapes on said cooling bed in said second direction, forming said shapes on said cooling bed into closely-spaced groups of shapes while moving them in said second direction only to thereby reduce the cooling the thereof as compared with their cooling during said step of moving said shapes on the cooling bed, elevating said groups of shapes from the cooling bed and transferring them along said first direction to cooling containers, and thereafter removing the groups of shapes from the cooling containers after cooling therein to a desired temperature.

* * * * *